US005923238A

United States Patent [19]

Polzehl et al.

[11] Patent Number: 5,923,238

[45] Date of Patent: Jul. 13, 1999

[54] OVERVOLTAGE PROTECTIVE MODULE

[75] Inventors: Heiko Polzehl; Ralf-Dieter Busse, both of Berlin, Germany

[73] Assignee: Krone Aktiengesellschaft, Berlin-Zehlendorf, Germany

[21] Appl. No.: 09/074,615

[22] Filed: May 7, 1998

[30] Foreign Application Priority Data

May 9, 1997 [DE] Germany ..... 197 21 047

[51] Int. Cl.[6] ..... H01H 85/26; H01H 85/25; H01C 7/12

[52] U.S. Cl. ..... 337/283; 337/295; 337/144; 361/118; 361/119

[58] Field of Search ..... 337/31–35, 18, 337/19, 148, 206, 144, 255, 259, 263, 268, 199, 228, 234, 295; 361/117, 118, 119, 120, 124, 127, 128, 98

[56] References Cited

U.S. PATENT DOCUMENTS

| | | | |
|---|---|---|---|
| 2,546,824 | 3/1951 | Koliss | 337/29 |
| 4,380,038 | 4/1983 | Roudeau | 361/119 |
| 4,504,883 | 3/1985 | Uchida et al. | 361/119 |
| 5,574,614 | 11/1996 | Busse et al. | 361/119 |

FOREIGN PATENT DOCUMENTS

| | | |
|---|---|---|
| 0 258 629 A2 | 3/1988 | European Pat. Off. . |
| 2 315 838 | 10/1974 | Germany . |
| A-2 315 838 | 10/1974 | Germany . |
| 24 28 266 C3 | 12/1975 | Germany . |
| 25 08 845 B2 | 1/1977 | Germany . |
| 25 55 794 C2 | 6/1977 | Germany . |

*Primary Examiner*—Leo P. Picard
*Assistant Examiner*—Anatoly Vortman
*Attorney, Agent, or Firm*—McGlew and Tuttle, P.C.

[57] ABSTRACT

An overvoltage protective module comprising a base body made of plastic with embedded contact strips, overvoltage suppressers arranged on the top of the base body and provided with fuse elements, and contact springs which hold the overvoltage suppressers and the fuse elements on the base body and are used to make contact with the contact strips when a fuse element softens in response to an overvoltage. In order to simplify the structure of such an overvoltage protective module, the contact springs (5) are formed on a spring comb (7) which can be clamped onto the top (6) of the base body (1) and whose web (8) which holds the contact springs (5) has at least one spring contact (9) for making contact with a ground conductor (10).

12 Claims, 4 Drawing Sheets

OVERVOLTAGE PROTECTIVE MODULE

FIELD OF THE INVENTION

The invention relates to an overvoltage protective module base body made of plastic with embedded contact strips, overvoltage suppressors arranged on the top of the base body and provided with fuse elements.

BACKGROUND OF THE INVENTION

An overvoltage protective module of this generic type is already known from DE-A-2 315 838. In this case, the contact springs are parts of a metallic holder having a U-shaped cross section, additional contact fingers being arranged at the free ends of the contact springs, in order to make contact with the contact strips which are embedded in the plastic base body. The U-shaped holder which has the contact springs necessitates complex assembly of the overvoltage suppressers, which are held on the top of the base body by the contact springs and are provided with fuse elements. Furthermore, the U-shaped holder requires a large amount of material.

SUMMARY AND OBJECTS OF THE INVENTION

The invention is based on the object of improving the overvoltage protective module of this type.

In order to achieve this object, the invention provides that the contact springs are formed on a spring comb which can be clamped onto the top of the base body and whose web which holds the contact springs has at least one spring contact in order to make contact with a ground conductor. In terms of the arrangement of the overvoltage suppressers provided with fuse elements, the overvoltage protective module according to the invention is thus designed to be more convenient for assembly since these overvoltage suppressers are held only by means of the spring comb, which can be clamped onto the top of the base body, on one side has the contact springs for holding the overvoltage suppressers, and on the other side has at least one spring contact in order to make contact with the ground conductor. In addition to simplified assembly, this results in a considerable saving in metallic material for construction of the contact springs. The integral nature of the spring comb reduces the complexity of the parts used to make contact between the overvoltage protective module and the ground conductor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
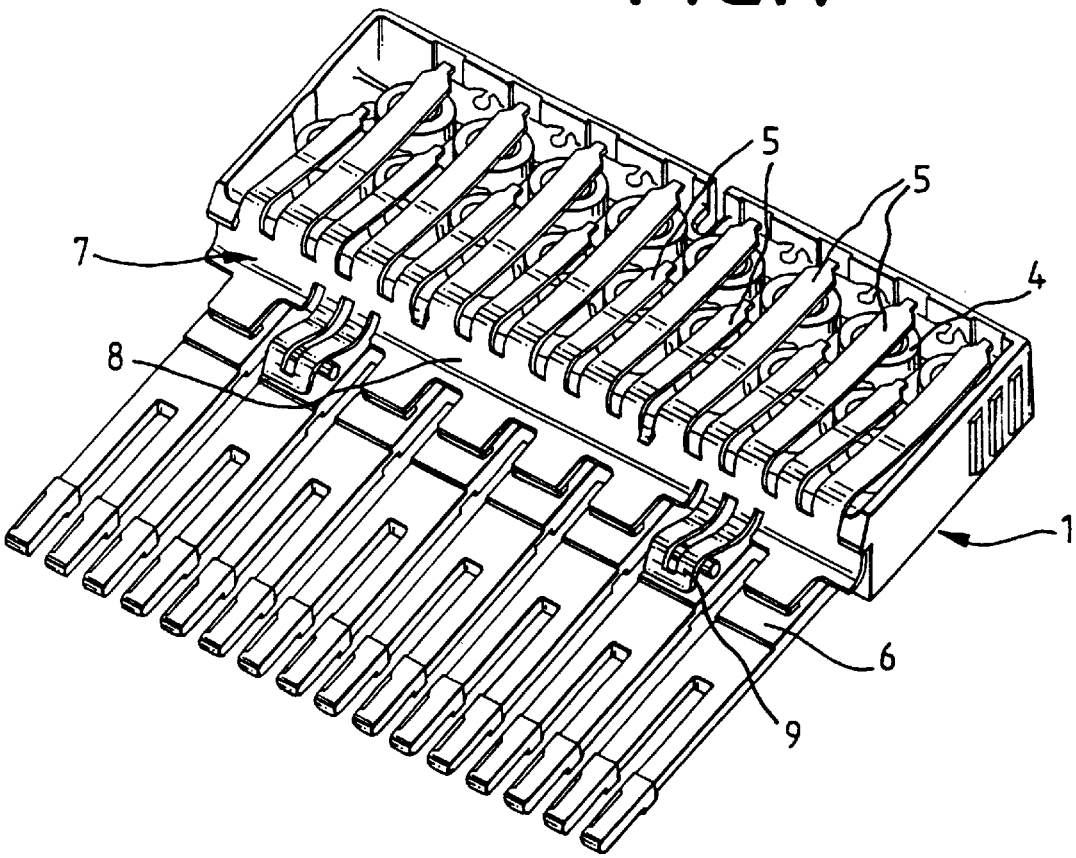
FIG. 1 is a perspective plan view of the overvoltage module.

Referring to the drawings in particular, the overvoltage protective module comprises a base body 1 made of plastic with embedded contact strips 2, overvoltage suppressers 4 arranged on the top of the base body 1 and provided with fuse elements 3, and contact springs 5 which hold the overvoltage suppressers 4 and the fuse elements 3 on the base body 1 and are used to make contact with the contact strips 2 when a fuse element 3 softens in response to an overvoltage. In this case, contact springs 5 are formed on a spring comb 7 which can be clamped onto the top 6 of the base body 1 and whose web 8 which holds the contact springs 5 has at least one spring contact 9 for making contact with a ground conductor 10.

Figure 4:
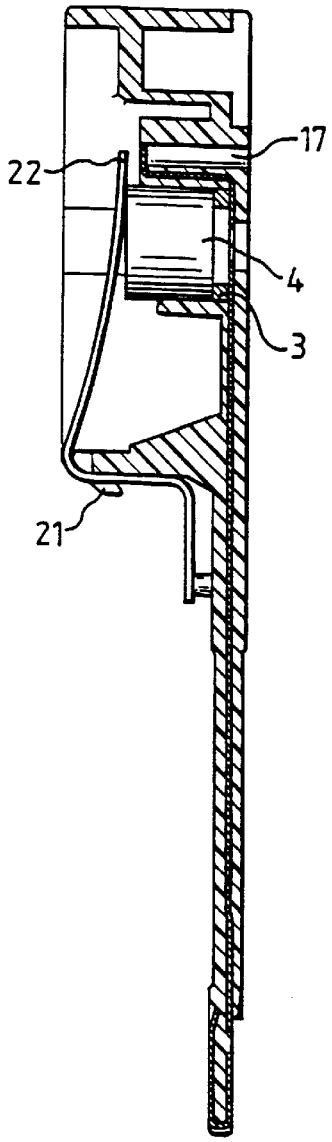
FIG. 4 is a sectional view taken through the overvoltage protective module along the line IV—IV in FIG. 3.
Figure 5:
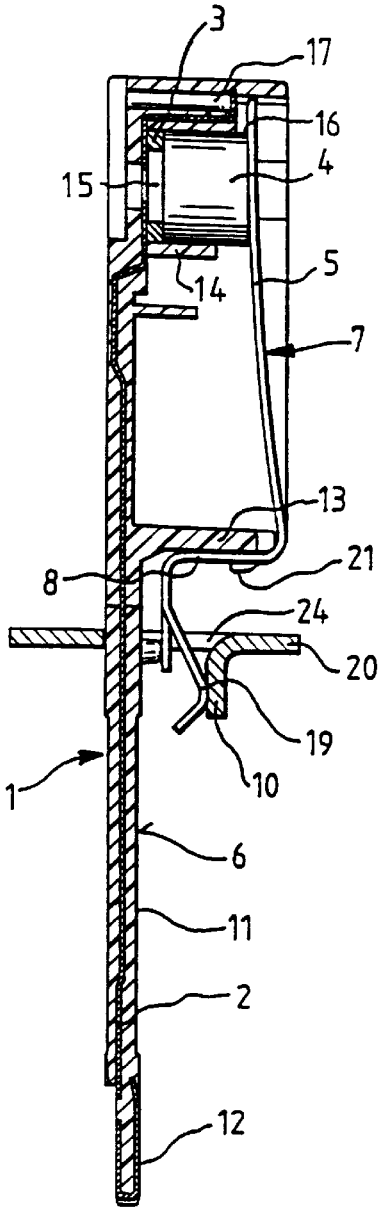
FIG. 5 is a sectional view taken through the overvoltage protective module along the line V—V in FIG. 3.

The plastic base body 1 comprises a base plate 11 in which the metallic contact strips 2 are embedded, at whose free ends contact pick-offs 12, designed in a U-shape, are exposed. On the top 6, the base plate 11 is fitted with a plastic strip 13 which runs in the longitudinal direction, that is to say transversely with respect to the contact strips 2, and, on the longitudinal side facing away from the free ends of the contact strips 2, it is fitted with two offset rows of circular walls 14 in order to form troughs 15 for holding the overvoltage suppressers 4 and the fuse elements 3 assigned to them. The contact strips 2, which are bent according to FIGS. 4 and 5, are exposed on the top edge 16 of the walls 14, and have contact ramps 17 opposite which the free ends of the contact springs 5 of the spring comb 7 are located, as can be seen in FIGS. 4 and 5. The strip 13 and the walls 14 are formed integrally from plastic with the base body 1 and the base plate 11.

Figure 2:
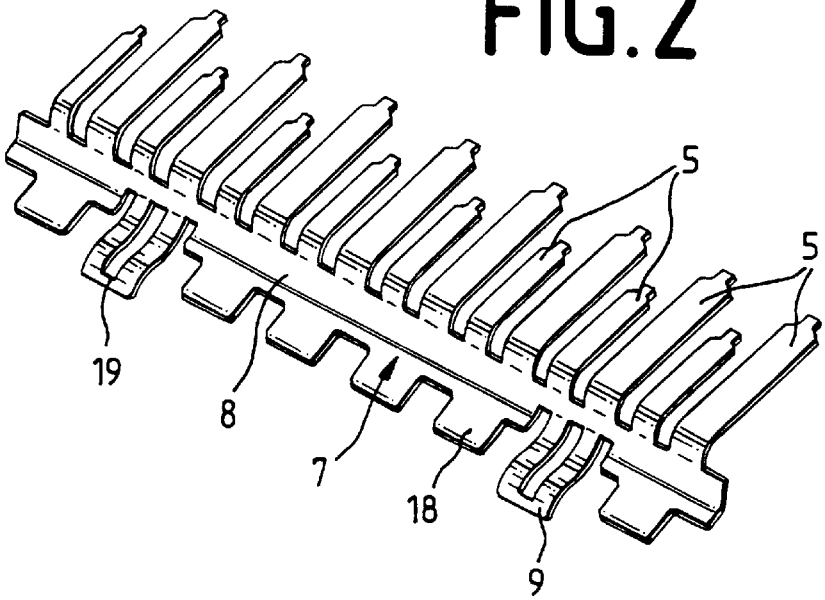
FIG. 2 is a perspective plan view of the spring comb.
Figure 3:
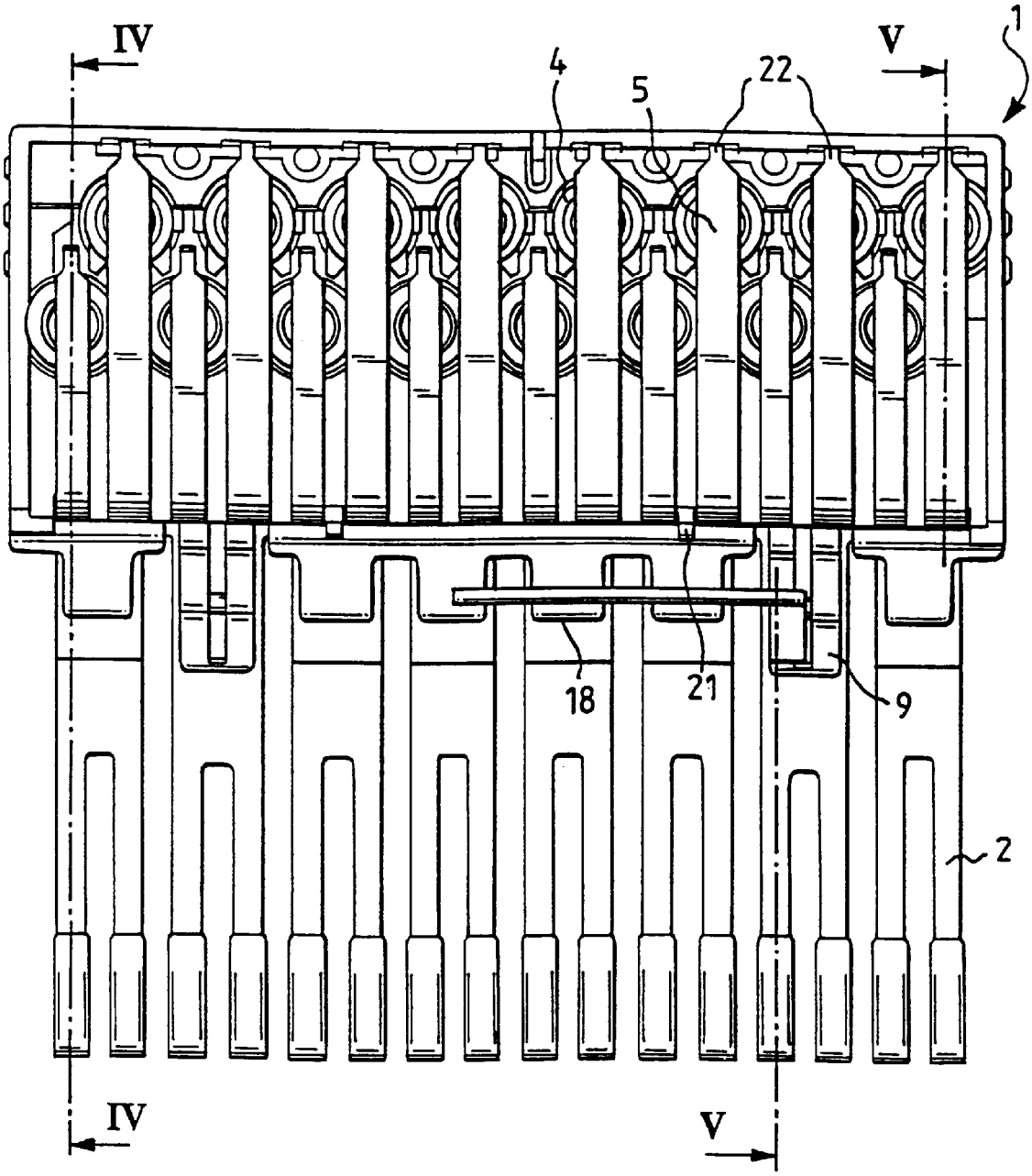
FIG. 3 is a plan view of the overvoltage protective module according to FIG. 1.

The spring comb 7, which is illustrated as a single component in FIG. 2, is composed of metallic, conductive material and comprises a continuous web 8, on one side of which the contact springs 5 are formed, and on the other side of which supporting elements 18 in the form of flaps are formed, with spring contacts 9 between them. The latter are formed as lugs 19 which are bent out of the plane of the web 8, are bent up in an L-shape and are cut out of the web 8, two such lugs 19 being provided, one of which is illustrated, in its functional position, in FIG. 5.

That end of the base body 1 which is provided with the free ends of the contact strips 2 forms the plug part of a protective plug. The spring contact 9 is designed to make contact with the ground conductor 10 on that side of the web 8 of the spring comb 7 which faces the free ends of the contact strips 2 and is arranged at that end of the base body 1 which is provided with the free ends of the contact strips 2. The free end of the base plate 11 of the base body 1 in this case passes through an opening 24 in a component 20 which forms the ground conductor 10, the lug 19 coming to rest against the ground conductor 10 of the component 20.

Once the spring comb 7 has been installed, the web 8 rests against the outside of the strip 13 of the base body 1, facing away from the troughs 15 for the overvoltage suppressers 4 and as illustrated in FIG. 4 and FIG. 5, the supporting elements 18 and the two spring contacts 9 together with the lugs 19 extending on one side of the web 8, and the bent contact springs 5 extending on the other side. The plastic strip 13 is provided on the side facing away from the troughs 15 for the overvoltage suppressers 4 with at least two latching tabs 21, behind which the web 8 of the spring comb 7 can be clamped in between two adjacent contact springs, as is illustrated in FIG. 4 and FIG. 5. Since the overvoltage suppressers 4 are arranged in two rows and offset with respect to one another in the troughs 15 on the top of the base body 1, the contact springs 5 for that row of overvoltage suppressers 4 which is further away from the strip 13 are designed to be longer than the contact springs 5 for that row of overvoltage suppressers 4 which is adjacent to the strip 13. This results in the design of the spring comb 7 illustrated in perspective in FIG. 2, with contact springs 5 of different lengths. These are fitted at their free ends with contact tabs 22, which are located opposite the respective contact ramps 17.

The overvoltage protective module illustrated in FIGS. 1 to 5 forms a protective plug, comprising the plastic base body 1 in which the contact strips 2, which form line contacts, are embedded, the spring comb 7 which is plugged onto the base body 1 and is made of spring material, and the overvoltage suppressers 4 together with fuse elements 3, which are arranged as a contact track between the individual overvoltage suppressers 4 and the respectively associated contact strip 2. In order to hold the overvoltage suppressers 4 and the fuse elements 3, the troughs 15 in the base body 1 are designed to be in offset rows with a high packing density in the longitudinal and lateral directions of the base body 1. In order to provide a short-circuit path, the ends of the contact strips 2 in the vicinity of the overvoltage suppressers 4 are designed as contact ramps 17, opposite which the contact tabs 22 of the contact springs 5 are located. When a relatively long-lasting overvoltage situation occurs, the respective overvoltage suppressor 4 is heated very severely. In consequence, the associated fuse element 3 softens. The spring effect of the plug-on spring comb 7 and of the associated contact spring 5 forces the overvoltage suppressor 4 downward. This movement results in the contact tab 22 of the associated contact spring 5 being pressed against the contact ramp 7 of the contact strip 2, and being short-circuited after making contact with the overvoltage suppressor 4. The overvoltage is now dissipated to ground via the contact spring 5 and the spring comb 7 which, by means of the spring contacts 9, makes contact with the ground conductor 10.

The spring comb 7 comprises relatively short and relatively long contact springs 5 arranged on one side of the web 8 in order to make contact with the electrodes of the overvoltage suppressers 4, and supporting elements 18, on the one hand, arranged on the other side of the web 8, as well as the spring contacts 9 in the form of lugs 19 in order to make ground contact. The contact springs 5 for making contact with the overvoltage suppressers 4, and the spring contacts 9 for making contact with the ground conductor 10, are formed in a single component, namely the spring comb 7. No further sprung contact elements are required to make contact with the ground conductor 10, which forms the common ground. The ground conductor 10 thus makes contact directly by means of an L-shaped lug 19 with the common ground, forming the interface to the distribution panel. The spring comb 7 is designed with an open structure and can thus be latched onto the top 6 of the plastic base body 1 easily and with a short installation movement. At the same time, the supporting elements 18 are used as a rest. The spring comb 7 is pushed, against the spring force of the contact springs 5, under the correspondingly designed latching tabs 21 on the strip 13, and is thus clamped onto the plastic base body 1. When installed, the spring comb 7 is easily accessible on the base body 1 and thus on the overvoltage protective module which forms a protective plug, and can be fitted and removed without any special aids. This allows protective components in the form of overvoltage suppressers 4 and fuse elements 3 to be replaced quickly and easily, in particular for on-site maintenance.

The contact springs 5 of the spring comb 7 may be provided (in a manner not illustrated in more detail) in the contact region with the overvoltage suppressers 4 with cup-shaped indentations as a fulcrum or rotation point. These are intended to counteract any upward movement of the overvoltage suppressor 4, and thus any possible opening of the contact in the u-region.

The troughs 15 are designed with a high packing density and, in addition to a lateral offset of the overvoltage protective module, they are also staggered in height This allows the sprung contact springs 5 to move independently in a very small space. If the rows of troughs 15 were not staggered, the contact springs 5 would have to be stepped for independent movement, in order that the front overvoltage suppressor does not limit the movement of the contact spring in the event of the lower overvoltage suppressor melting which would make it more difficult to manufacture the spring comb 7.

Figure 7:
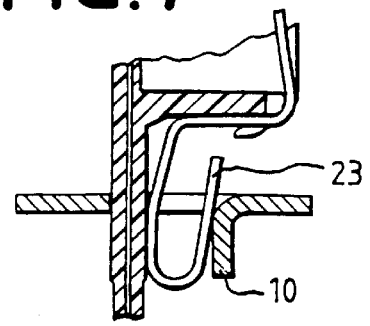
FIG. 7 is an enlarged detail of the modified embodiment of the spring contact for making contact with the ground contact according to FIG. 6.
Figure 6:
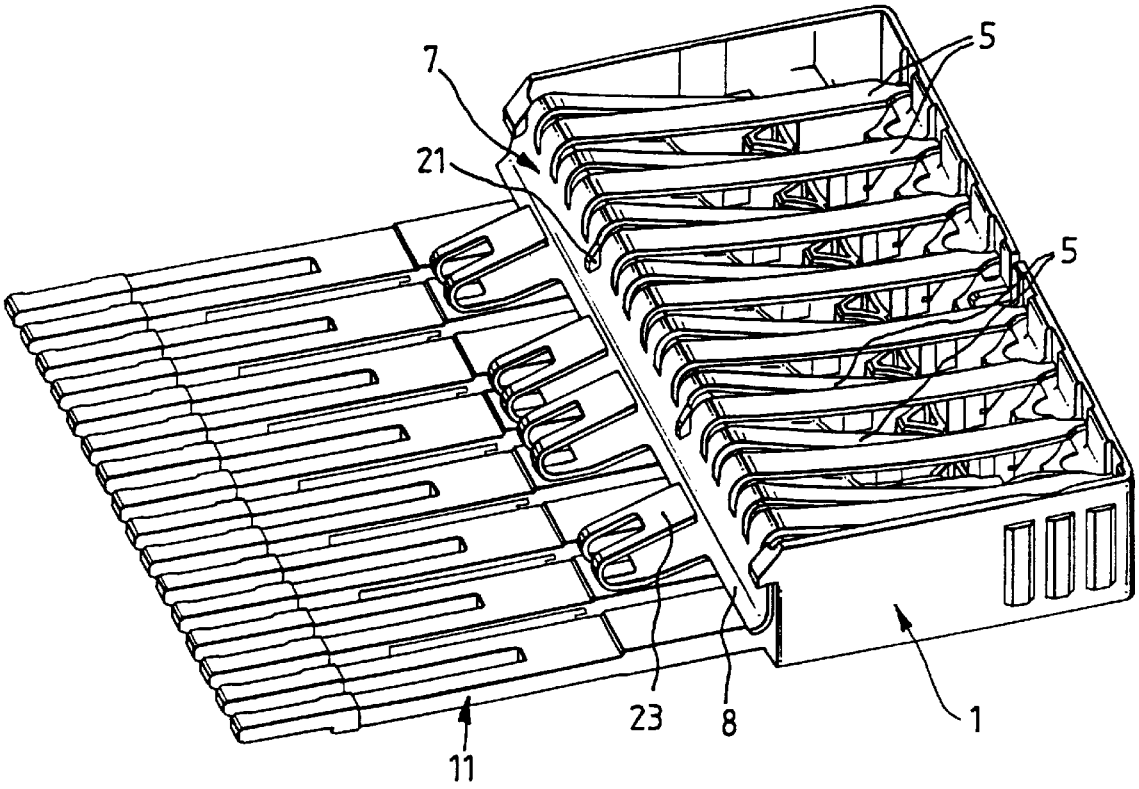
FIG. 6 is a perspective plan view of the modified embodiment of the overvoltage protective module.

In the modified embodiment illustrated in FIG. 6 and FIG. 7, the spring contacts 9 are formed as lugs 23 which are bent out of the plane of the web 8 at its free end in a U-shape, are cut out of the web 8, correspond to the lugs 19 in the embodiment according to FIG. 1 to FIG. 5, and make contact with the ground conductors 10 of the component 20 in the opening 24.

While specific embodiments of the invention have been shown and described in detail to illustrate the application of the principles of the invention, it will be understood that the invention may be embodied otherwise without departing from such principles.

What is claimed is:

1. An overvoltage protective module comprising:

a base body made of plastic with embedded contact strips, said base body having a top;

overvoltage suppressers arranged on said top of said base body and provided with fuse elements;

a spring comb including contact springs which hold said overvoltage suppressers and said fuse elements on said base body and are used to make contact with said contact strips when a fuse element softens in response to an overvoltage situation, said spring comb being clampable onto said top of said base body, said spring comb having a web which holds said contact springs and has at least one spring contact for making contact with a ground conductor, said spring contact is bent up out of a plane of said web and said spring contact is cut out of said web, said spring contact being formed as a lug in one of a L-shape and an U-shape.

2. The overvoltage protective module as claimed in claim 1, wherein said top of said base body is provided with walls in the form of circular arcs in order to form troughs for holding said overvoltage suppressers and said contact strips have bent contact ramps which are formed on said top edge of said walls and opposite which said free ends of said contact springs of said spring comb are located.

3. The overvoltage protective module as claimed in claim 2, wherein said base body includes a plastic strip formed on said top between said troughs for said overvoltage suppressers and free ends of said contact strips and is provided on a side facing away from said troughs for said overvoltage suppressers with latching tabs, behind which said web of said spring comb can be clamped in.

4. The overvoltage protective module as claimed in claim 3, wherein said overvoltage suppressers are arranged in at least two rows and offset with respect to one another on said top of said base body, wherein contact springs for a row of overvoltage suppressers which is further away from the strip are longer than said contact springs for a row of overvoltage suppressers which is adjacent to the strip.

5. The overvoltage protective module as claimed in claim 1, wherein an end of said base body which is provided with free ends of said contact strips forms a plug part of a protective plug, and the at least one spring contact for making contact with the ground conductor is formed on that side of said web of said spring comb which faces the free ends of said contact strips and is arranged at that end of said base body which is provided with the free ends of said contact strips.

6. The overvoltage protective module as claimed in claim 1, wherein said spring contact is formed as a lug in an L-shape, and said ground conductor is external to the overvoltage protective module.

7. An overvoltage protective module comprising:

a plastic base body having a top and having a plurality of embedded contact strips;

a plurality of overvoltage suppressers arranged on said top of said base body and provided with fuse elements;

a spring comb including a plurality of contact springs, each of said contact springs holding an overvoltage suppressor and the associated fuse element on said base body, each contact spring including contact means for making contact with said contact strips when an associated fuse element softens in response to an overvoltage situation, said spring comb having a web connected to said contact springs and said spring comb having at least one spring contact for making contact with a ground conductor;

clamping means for clamping said spring comb onto said top of said base body;

said base body top is provided with circular arc walls defining troughs for holding said overvoltage suppressers; and said contact strips have bent contact ramps which are formed on a top edge of said walls and opposite which free ends of said contact springs of said spring comb are located.

8. The overvoltage protective module as claimed in claim 7, wherein said base body includes:

a plastic strip formed on said top between said troughs for said overvoltage suppressers and free ends of said contact strips; and latching tabs forming a part of said clamping means on a side facing away from said troughs for said overvoltage suppressers, said latching tabs defining a region behind which said web of said spring comb can be clamped in.

9. The overvoltage protective module as claimed in claim 8, wherein said overvoltage suppressers are arranged in at least two rows and offset with respect to one another on said top of said base body, wherein contact springs for a row of overvoltage suppressers which is further away from said web are longer than said contact springs for a row of overvoltage suppressers which is closer to said web.

10. An overvoltage protective module comprising:

a plastic base body having a top and having a plurality of embedded contact strips, an end of said base body includes free ends of said contact strips and forms a plug part of a protective plug;

a plurality of overvoltage suppressers arranged on said top of said base body and provided with fuse elements;

a spring comb including a plurality of contact springs, each of said contact springs holding an overvoltage suppressor and the associated fuse element on said base body, each contact spring including contact means for making contact with said contact strips when an associated fuse element softens in response to an overvoltage situation, said spring comb having a web connected to said contact springs and said spring comb having a spring contact for making contact with a ground conductor, said spring contact is formed on a side of said web of said spring comb which faces said free ends of said contact strips and is arranged at said end of said base body with said free ends of said contact strips;

clamping means for clamping said spring comb onto said top of said base body.

11. The overvoltage protective module as claimed in claim 10, wherein said spring contact is formed as a lug which is bent up out of a plane of said web in an L-shape and is cut out of said web.

12. The overvoltage protective module as claimed in claim 10, wherein said spring contact is formed as a lug which is bent out of a plane of said web at a free end in a U-shape and is cut out of said web.

* * * * *